US008523353B2

(12) United States Patent
Biton et al.

(10) Patent No.: US 8,523,353 B2
(45) Date of Patent: Sep. 3, 2013

(54) METHOD OF CALCULATING A SETPOINT FOR BEVELING OR GROOVING AN OPHTHALMIC LENS

(75) Inventors: Jérémie Biton, Charenton-le-Pont (FR); David Freson, Charenton-le-Pont (FR); Eric Belloni, Charenton-le-Pont (FR); Thierry Allouis, Charenton-le-Pont (FR); Benoit Holvoet Vermaut, Charenton-le-Pont (FR)

(73) Assignee: Essilor International (Compagnie Generale d'Optique), Charenton le Pont (FR)

( * ) Notice: Subject to any disclaimer, the term of this patent is extended or adjusted under 35 U.S.C. 154(b) by 0 days.

(21) Appl. No.: 13/179,022

(22) Filed: Jul. 8, 2011

(65) Prior Publication Data

US 2012/0133886 A1 May 31, 2012

(30) Foreign Application Priority Data

Jul. 20, 2010 (FR) ..... 10 03047

(51) Int. Cl.
*G02C 7/02* (2006.01)

(52) U.S. Cl.
USPC ..... 351/159.74; 351/159.67

(58) Field of Classification Search
USPC ..... 351/159.01, 159.67, 159.74; 451/42, 451/43
See application file for complete search history.

(56) References Cited

U.S. PATENT DOCUMENTS 6,688,944 B2 * 2/2004 Hatano et al. ..... 451/5

FOREIGN PATENT DOCUMENTS

| | | | |
|---|---|---|---|
| EP | 1 642 678 | A1 | 4/2006 |
| EP | 1 767 983 | A1 | 3/2007 |
| EP | 2 031 435 | A1 | 3/2009 |

OTHER PUBLICATIONS

French Search Report, dated Apr. 27, 2011, from corresponding French application.

* cited by examiner

*Primary Examiner* — Darryl J Collins
(74) *Attorney, Agent, or Firm* — Young & Thompson

(57) ABSTRACT

A method of calculating a shaping setpoint for an ophthalmic lens along a longitudinal profile includes:

an operation of acquiring an initial longitudinal profile;

an operation of centering the initial longitudinal profile on the lens;

an operation of searching for two remarkable points of the initial longitudinal profile as a function of determined criteria;

an operation of calculating a modified axial coordinate for each remarkable point in order to ensure proper mounting and esthetic appearance of the lens in its eyeglass frame; and an operation of calculating a final longitudinal profile resulting from a transformation of the initial longitudinal profile that is such that the final longitudinal profile passes through the two remarkable points.

20 Claims, 5 Drawing Sheets

METHOD OF CALCULATING A SETPOINT FOR BEVELING OR GROOVING AN OPHTHALMIC LENS

TECHNICAL FIELD TO WHICH THE INVENTION RELATES

The present invention relates in general to the field of eyeglasses.

It relates more particularly to calculating the position that is to be presented by the engagement groove or ridge on the edge face of the ophthalmic lens that is to be machined, in order to enable it to be mounted in a surround of a rimmed or half-rimmed eyeglass frame.

TECHNOLOGICAL BACKGROUND

The technical part of the profession of an optician consists in mounting a pair of correcting ophthalmic lenses in an eyeglass frame selected by a wearer.

This mounting comprises at least three main operations:

- acquiring the shape of a longitudinal profile representative of the shape of the outline of one of the surrounds of the selected eyeglass frame;
- centering the ophthalmic lens under consideration, i.e. positioning and orienting said longitudinal profile appropriately on the lens, in such a manner that once machined to have this profile and then mounted in its frame, the lens is positioned correctly relative to the corresponding eye of the wearer, so as to enable it to perform as well as possible the optical function for which it is designed; and then
- shaping the lens, i.e. machining its outline to have the shape of the longitudinal profile.

With rimmed eyeglass frames, the surround (or "rim") is designed to surround the entire periphery of the lens. Shaping then consists in a beveling operation which consists in forming an engagement ridge all along the edge face of the lens for the purpose of engaging in a groove, commonly known as a bezel, that runs around the inside face of the rim of the eyeglass frame.

With half-rimmed eyeglass frames, the surround comprises a half-rim that matches the top portion of the outline of the lens, and a string that runs along the bottom portion of the outline of the lens in order to hold the lens against the half-rim. Shaping then includes a grooving operation that consists in forming an engagement groove along the edge face of the lens, with the top portion of the groove serving to receive a ridge provided along the bottom face of the half-rim and with the bottom portion of the groove serving to receive the string.

Generally, in order to ensure that the engagement ridge or groove does not overflow into the front or the rear of the edge face of the lens, the optician machines the lens in such a manner that the engagement ridge or groove follows the front optical face of the lens, so that it extends at a constant optical distance from said front optical face.

It is also known to machine the lens in such a manner that the engagement ridge or groove extends halfway across its edge face.

Nevertheless, neither of those two methods is flexible.

It can thus happen that once a pair of eyeglasses has been assembled, its appearance is esthetically unpleasing because of the way the lenses are positioned in the surrounds of the frame in compliance with the above-mentioned constraint. In particular, it is sometimes found that if the edge face of the lens is particularly thick, then it projects in unsightly manner from the rear of the surround.

It is also sometimes found to be impossible to mount the lens as a result of interference between the rear edge of the edge face of the lens and the corresponding nose pad of the eyeglass frame.

The likelihood of this occurring is made worse in that eyeglass frames exist in a very wide variety of shapes, as do ophthalmic lenses.

SUMMARY OF THE INVENTION

In order to remedy the above-mentioned drawbacks of the prior art, the present invention proposes a method of calculating the position of the engagement ridge or groove on the edge face of the lens, which method provides greater flexibility in selecting said position so as to avoid any interference or unsightly appearance of the mounting.

More particularly, the invention provides a method of calculating the shape of a longitudinal profile of an engagement ridge or groove for machining on the edge face of an ophthalmic lens.

According to the invention, the method comprises:

- an operation of acquiring the shape of an initial longitudinal profile;
- an operation of prepositioning said initial longitudinal profile in a coordinate system tied to the ophthalmic lens;
- an operation of searching for two remarkable points of said initial longitudinal profile, which points are distinct from each other, said operation comprising:
  - a) acquiring a plurality of characteristics relating to the ophthalmic lens and/or to the initial longitudinal profile;
  - b) determining whether any of said acquired characteristics satisfies a decision criterion, by comparing the value of said acquired characteristic with a predetermined threshold value;
  - c) selecting the first remarkable point from a first list of points of said initial longitudinal profile as being the point at which one of said acquired characteristics satisfies a first positioning criterion, said first positioning criterion being selected as a function of the result of step b); and
  - d) selecting the second remarkable point from a second list of points of said initial longitudinal profile, as being the point at which one of said acquired characteristics satisfies a second positioning criterion, said second list being deduced from the result of step c);
- an operation of correcting the position of each remarkable point along an axial direction substantially perpendicular to a mean plane of the ophthalmic lens; and
- an operation of calculating the three-dimensional shape of a final longitudinal profile in the coordinate system of the ophthalmic lens, resulting from a geometrical transformation of the initial longitudinal profile that is such as to cause the final longitudinal profile to pass via the first and second remarkable points as modified during the preceding operation.

This method makes it possible to detect the two point of the longitudinal profile where the risks are greatest of presenting an esthetic problem or a mounting problem. These points are referred to as "remarkable points".

Thereafter, the method makes it possible, where necessary, to modify the coordinates of these two remarkable points in such a manner as to move the longitudinal profile of the position that was initially allocated thereto (halfway across the edge face of the lens or along the front face of the lens) in such a manner as to overcome these esthetic or mounting problems.

The first remarkable point is selected as a function of a decision criterion and a positioning criterion. These two criteria in combination serve to determine firstly the maximum risk run by the optician if the lens were to be shaped using the initial longitudinal profile (problems of esthetic appearance, mounting, . . . ), and secondly the point along the initial longitudinal profile where the risk is at a maximum (nose side of the frame, temple side, . . . ).

The second remarkable point is selected as a function of another positioning criterion in order to determine from a list of points that have been selected as a function of the first remarkable point, the point where the greatest risk of a problem arising (which problem may be the same as or different from the first problem).

The modified axial coordinate of each remarkable point is corrected along an axial direction that is substantially perpendicular to the mean plane of the lens in compliance with an axial positioning rule that depends on the results of steps b) to d). This axial positioning rule is selected as a function of the problem that needs to be solved.

Other characteristics of the calculation method of the invention that are advantageous but not limiting are as follows:

- each positioning criterion consists in selecting from the points of the first or second list of points the point at which the value of the acquired characteristic is at a maximum or a minimum;
- each characteristic acquired in step a) relates to the shape of the ophthalmic lens or to the axial position of the initial longitudinal profile relative to one of the optical faces of the ophthalmic lens;
- in step b), said decision criterion relates to the thickness of the ophthalmic lens at least one point of the initial longitudinal profile;
- said decision criterion consists in determining whether the minimum thickness of the ophthalmic lens along the initial longitudinal profile is less than a thickness threshold;
- said decision criterion consists in determining whether the axial distance between the rear face of the ophthalmic lens and the initial longitudinal profile is, at least one point situated in a nose zone of said initial longitudinal profile, less than an interference threshold;
- in step b), if the decision criterion is not satisfied, provision is made for determining whether one of the characteristics acquired in step a) satisfies another decision criterion, and in step c), the first positioning criterion is selected also as a function of the result obtained with said other decision criterion;
- in step c), the first positioning criterion relates to the minimum thickness of the ophthalmic lens along the initial longitudinal profile;
- the first remarkable point corresponds to the point of the initial longitudinal profile at which the thickness of the ophthalmic lens is at a minimum;
- in step c), the first positioning criterion relates to the ratio of the axial distance between the initial longitudinal profile and one of the optical faces of the ophthalmic lens divided by the thickness of the ophthalmic lens;
- for said optical face being the rear face of the ophthalmic lens, the first remarkable point corresponds to the point in the first list that presents the maximum ratio;
- the first list of points comprises exactly four points respectively situated at less than ten millimeters in curvilinear abscissa from the four points of intersection between the initial longitudinal profile and the two axes of symmetry of the boxing rectangle of said initial longitudinal profile;
- the first list of points comprises exactly four points respectively situated at the intersections of the initial longitudinal profile and the boxing rectangle of said initial longitudinal profile;
- the second list comprises two points situated at less than ten millimeters in curvilinear abscissa from the two points of intersection between the initial longitudinal profile and one of the two axes of symmetry of the boxing rectangle of said initial longitudinal profile, said axis of symmetry being the axis of symmetry that is the furthest away from the first remarkable point;
- wherein the second positioning criterion relates to the ratio of the axial distance between the initial longitudinal profile and one of the optical faces of the ophthalmic lens divided by the thickness of the ophthalmic lens; and
- in step d), the second remarkable point is selected in such a manner that it lies at least thirty millimeters in curvilinear abscissa from the first remarkable point.

BRIEF DESCRIPTION OF THE DRAWING FIGURES

The following description made with reference to the accompanying drawings, given by way of non-limiting example, makes it clear what the invention consists in and how it can be reduced to practice.

DETAILED DESCRIPTION OF THE INVENTION

In the present description, attention is paid more particularly to preparing two ophthalmic lenses to enable to be mounted in two surrounds (or "rims") of a rimmed eyeglass frame. As described in greater detail at the end of this description, the present invention also applies to preparing two ophthalmic lenses for mounting in two surrounds (or "half-rims") of a half-rimmed eyeglass frame.

Consequently, the eyeglass frame 10 under consideration at this point has two rims that are connected together by a bridge, each rim carrying a respective temple. Each rim of the frame also presents a groove, commonly called as a "bezel" running all around the outline of each rim and open towards the center of the rim.

Figure 1:
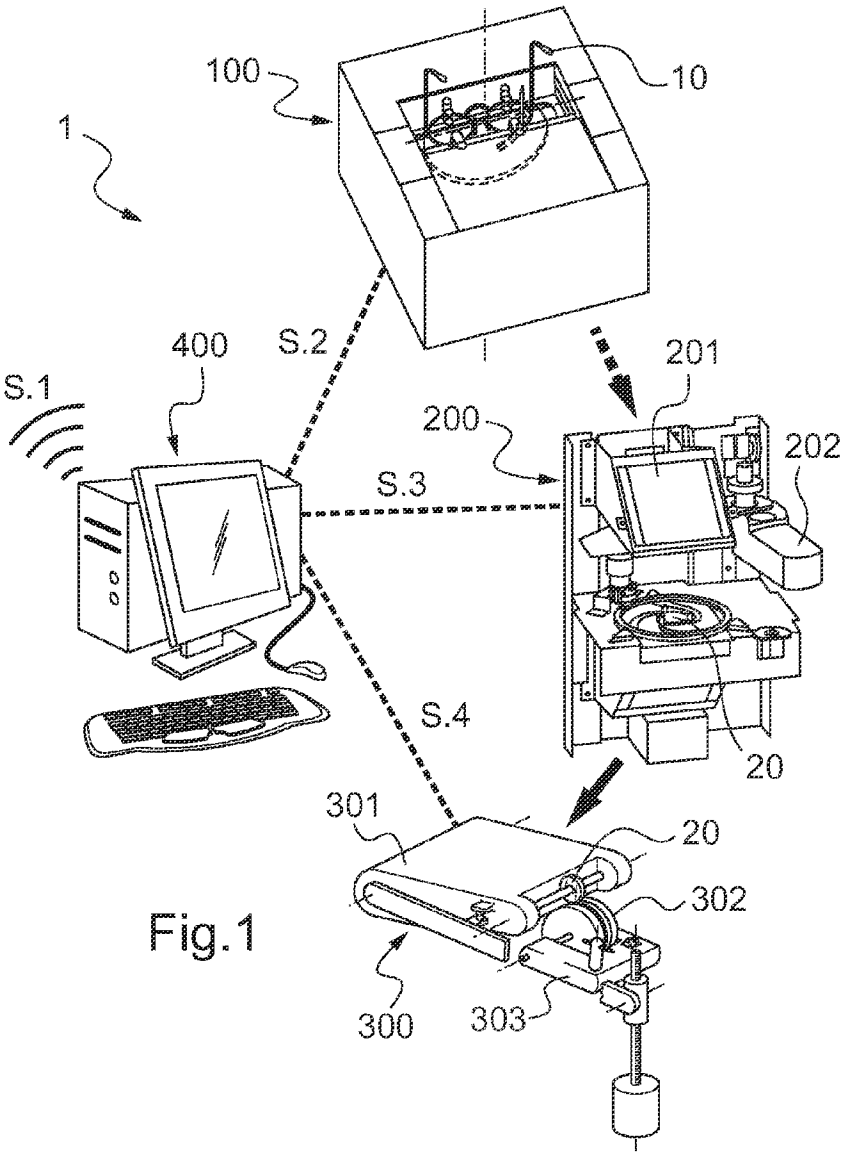
FIG. 1 is a diagrammatic perspective view of appliances available to an optician, making it possible to prepare two ophthalmic lenses for mounting in the two surrounds of an eyeglass frame.

FIG. 1 is a diagram showing the various appliances that enable an optician to prepare a job of two ophthalmic lenses 20 for mounting in an eyeglass frame 10 as previously selected by the future wearer of the pair of eyeglasses.

A first operation S.1 implemented by the optician consists in determining the future wearer's visual acuity and needs (single-vision or progressive lenses, transparent or colored lenses, . . . ), and in communicating this information to a lens manufacturer. At this time, the optician makes the future wearer wear the eyeglass frame (which is then generally fitted with presentation lenses) in order to identify the positions of the future wearer's pupils relative to the frame. Each point that is identified is referred to as a pupil point.

The ophthalmic lenses 20 are then molded and machined by the manufacturer so as to present the looked-for optical powers. They are then sent to the optician who is responsible for cutting out their outlines to the shape of the rims of the selected eyeglass frame.

To do this, the optician has an outline-reader appliance 100, a centering and blocking appliance 200, and a shaper appliance 300. In this example, all three of these appliances are controlled by a common control unit 400. In a variant, they could naturally be controlled by distinct control units.

During a second operation S.2, the optician uses the outline-reader appliance 100 to read the shape (or "trace") of a longitudinal profile running along the outline of the bezel of each of the rims of the selected eyeglass frame.

The centering and blocking appliance 200 is used during a third operation S.3 respectively to center these two longitudinal profiles on the ophthalmic lenses 20 (see FIG. 3) so that once they have been shaped with this longitudinal profile and mounted in the frame, the lenses are properly positioned relative to the eyes of the wearer.

The shaper appliance 300 serves, during a fourth and last operation S.4, to shape the two ophthalmic lenses 20 to have these two longitudinal profiles.

Figure 2:
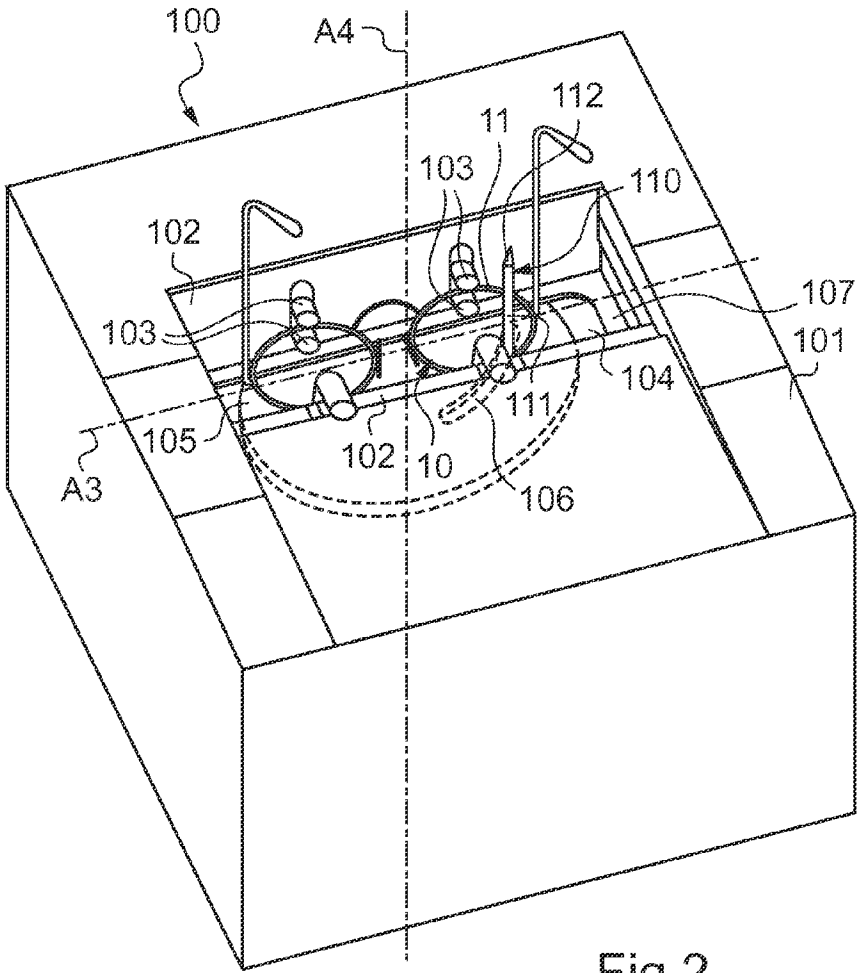
FIG. 2 is a diagrammatic perspective view of one of the FIG. 1 appliances, namely the appliance for reading the outlines of the surrounds of the eyeglass frame.

In FIG. 2, there can be seen in greater detail the outline-reader appliance 100.

This outline-reader appliance is well known to the person skilled in the art and does not itself form the subject matter of the invention described. By way of example, it is described in patent EP 0 750 172. It is also sold by Essilor International under the trademark Kappa CT.

This appliance comprises a top cover 101 covering the entire appliance with the exception of a central top portion into which the selected eyeglass frame 10 is placed.

It has a set of two jaws 102 in which at least one of the jaws 102 is movable relative to the other so that the jaws 102 can be moved towards each other or away from each other in order to form a clamping device. Each of the jaws 102 is also provided with two clamps, each formed by two movable studs 103 that can be moved to clamp between them the eyeglass frame 10 in order to hold it steady.

In the space left visible by the central top opening in the cover 101, there can be seen a structure 107. A plate 104 is movable in translation on the structure 107 along a transfer axis A3.

A turntable 105 is mounted to rotate on the plate 104.

The turntable 105 is thus suitable for taking up two positions along the transfer axis A3 by virtue of the plate 104 moving in translation on the structure 107, these positions comprising a first position in which the turntable 105 has its center located between the two pairs of studs 103 holding the right rim of the eyeglass frame 10, and a second position in which the turntable 105 has its center located between the two pairs of studs 103 holding the left rim of the eyeglass frame 10.

The turntable 105 possesses an axis of rotation A4 defined as being the axis normal to the front face of the turntable 105 and passing through its center. It is adapted to pivot about this axis relative to the plate. The turntable 105 also has a circularly arcuate oblong slot 106 through which there projects a feeler 110. The feeler 110 comprises a support rod 111 of axis perpendicular to the plane of the front face of the turntable 105, and at its free end it has a feeler finger 112 of axis perpendicular to the axis of the support rod 111. The feeler finger 112 is designed to slide or possibly roll over the edge at the bottom of the bezel in each of the rims 11 of the eyeglass frame 10, in order to scan it.

The shape reader appliance 100 includes actuator means (not shown in the figure) that are adapted firstly to cause the support rod 111 to slide along the slot 106 so as to modify its radial position relative to the axis of rotation A4 of the turntable 105, secondly to vary the angular position of the turntable 105 about its axis of rotation A4, and thirdly to position the feeler finger 112 of the feeler 110 at a higher or lower altitude relative to the front face of the turntable 105.

To summarize, the feeler 110 is provided with three degrees of freedom, a first degree of freedom R that is constituted by the ability of the feeler 110 to move radially relative to the axis of rotation A4 as a result of its freedom to move along the circular arc formed by the slot 106, a second degree of freedom THETA constituted by the ability of the feeler 110 to pivot about the axis of rotation A4 as a result of the turntable 105 rotating relative to the plate, and a third degree of freedom Z constituted by the ability of the feeler 110 to move in translation along an axis parallel to the axis of rotation A4 of the turntable 105.

Each point read by the end of the feeler finger 112 of the feeler 110 is identified in a corresponding system of coordinates R, THETA, Z.

The method whereby the outline-reader appliance 100 acquires the longitudinal profile of the bezel is as follows.

Initially, the eyeglass frame 10 is inserted between the studs 103 of the jaws 102 of the reader appliance 100 so that each of the rims 11 is ready to be felt along a path, starting by inserting the feeler 110 between the two studs 103 that clamp onto the bottom portion of the corresponding rim of the frame, and then running along the bezel of the rim, so as to cover the entire outline of the bezel.

In the initial position, when the feeler finger 112 is placed between the two studs 103, the control unit 400 defines both the angular position $THETA_j$ and the altitude $Z_j$ of the end of the feeler finger 112 of the feeler 110 as being equal to zero.

The actuator means then cause the turntable 105 to pivot. While it is pivoting, the actuator means impart a constant radial force urging the feeler 110 towards the bezel, so that the feeler finger 112 of the feeler 110 slides along the edge at the bottom of the bezel without rising along the front or rear flanks of the bezel.

While the turntable 105 is rotating, the control unit 400 reads the three-dimensional coordinates $R_{1j}$, $THETA_{1j}$, $Z_{1j}$ of a plurality of points along the bottom edge of the bezel, here 360 points that are angularly spaced apart at one degree intervals around the axis of rotation A4. These 360 points thus characterize the shape of the bottom edge of the bezel of the rim under consideration.

The centering and blocking appliance 200 shown in FIG. 1 is designed firstly to read the positions of the centering marks on each ophthalmic lens 20 that is to be prepared, and secondly to block the ophthalmic lens 20 by placing a blocking accessory on its front face.

This centering and blocking appliance 200 is well known to the person skilled in the art and does not itself form the subject matter of the invention described. Its architecture and its operation are described in detail, for example in patent document EP 1 722 924.

The appliance includes in particular acquisition means 201 for acquiring an image of the lens, and analysis means for analyzing the image so as to determine the position of the optical coordinate system of the ophthalmic lens 20.

It also includes feeler means for feeling the front and rear faces of the ophthalmic lens 20. In general, these feeler means comprise two feeler arms having their free ends directed towards each other in order to feel the front and rear faces of the lens.

It also includes blocking means 202 that comprise an automatic blocking arm suitable for using a clamp to take hold of a blocking accessory and for placing it at a determined location on the front face of the ophthalmic lens 20, which location is selected as a function of the acquired position of the optical coordinate system of the lens.

The blocking accessory thus constitutes a mark representative of the position of the optical coordinate system of the ophthalmic lens. It is designed to be engaged in a corresponding housing of the shaper appliance 300 and therefore enables the shaper appliance 300 to be aware of the position of the optical coordinate system of said ophthalmic lens.

The shaper appliance 300 is also well known to the person skilled in the art and does not itself form the subject matter of the invention described. It may be implemented in the form of any machine for cutting away or removing material that is suitable for modifying the outline of the ophthalmic lens 20 in order to make it match the shape of the selected frame.

As shown in FIG. 1, this appliance is constituted by an automatic grinder 300, commonly said to be numerically controlled. Specifically, this grinder comprises:

- a rocker 301 that is controlled in pivoting and that includes support arms arranged to support the ophthalmic lens 20 that is to be machined and to enable it to be pivoted about a support axis;
- a grindwheel-carrier carriage 302 fitted in particular with a beveling grindwheel presenting a groove that firstly is mounted to rotate about an axis parallel to the support axis in order to remove unwanted material from the lens by pivoting the rocker and its shafts, and that secondly is controlled to move in translation along said axis in order to form an engagement ridge (or "bevel") all around the edge face of the ophthalmic lens, at a greater or smaller distance from the front face of the lens; and
- a finishing module 303 that is controlled to tilt towards or away from the ophthalmic lens 20 and that carries means for finishing the ophthalmic lens 20, in order to groove it, chamfer it, polish it, . . . .

Figure 3:
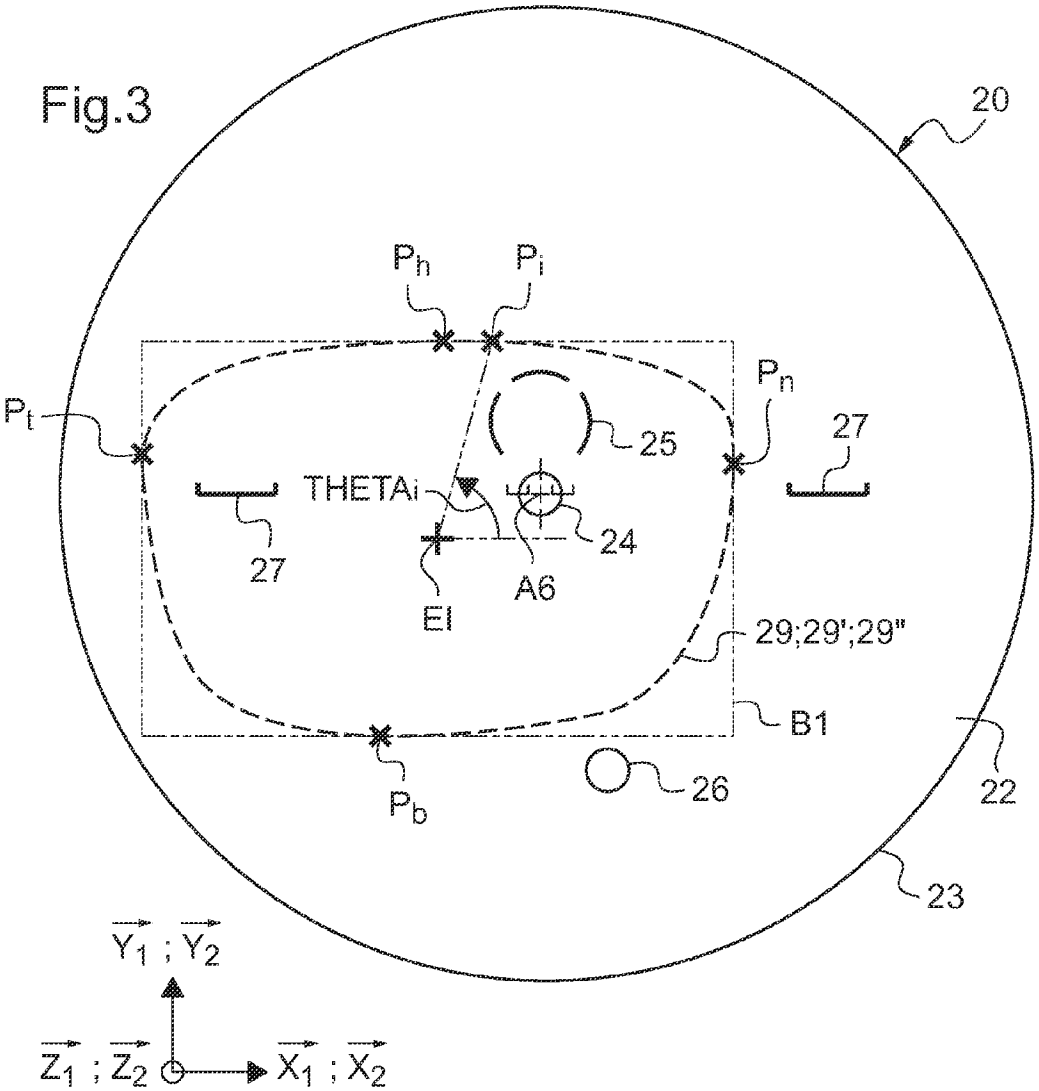
FIG. 3 is a diagrammatic face view of an ophthalmic lens that has not been shaped, showing the marks for centering the lens and, as a dashed line, the outline to which the lens is to be shaped.

FIG. 3 is a face view of an ophthalmic lens 20 in the presentation it has, when sent by the lens manufacturer to the optician.

In conventional manner, the ophthalmic lens 20 presents two optical faces comprising a convex front face 22 and a concave rear face 21, together with an edge face 23 that is initially circular.

On its front face 22, the ophthalmic lens 20 carries temporary centering marks 24-27 that are applied on the lens by the manufacturer in order to situate the positions of characteristic points of the lens.

Reference may also be made to permanent centering marks that are generally presented in the form of micro-etching. The temporary centering marks nevertheless facilitate centering the lens before it is mounted on an eyeglass frame, whereas the permanent centering marks are generally intended for the purpose of identifying the nature and the characteristics of the lens after the temporary centering marks have been erased.

In this example, the temporary centering marks 24-27 comprise:

- a target 24 that locates the "optical centering point" of the lens 20, this optical centering point conventionally corresponding to the point where the spherical refringence power of the lens is zero (for a single vision lens) or the "prism reference point" where the nominal prismatic power of the ophthalmic lens is measured, which power corresponds to the wearer's prescription (for a progressive lens);
- a circular arc 25 marking the center of the far vision zone of the lens;
- a circle 26 marking the center of the near vision zone of the lens; and
- two horizon lines 27 identifying the horizontal for the ophthalmic lens 10.

The optical axis A6 of the ophthalmic lens 20 is then defined as being the axis that passes through the center of the target 24 and that is normal to the front face 22 of the lens at the center of the target 24.

The coordinate system of the ophthalmic lens 20 is a rectangular coordinate system ($X_1$; $Y_1$; $Z_1$) defined as being the system presenting its origin at the center of the target 24, a first axis $X_1$ parallel to the horizon lines 27, a second axis $Y_1$ directed upwards relative to the lens, and a third axis $Z_1$ parallel to the optical axis A6 and directed towards the front of the ophthalmic lens 20.

FIG. 3 also shows as a dashed line the initial outline 29 to which the lens is to be shaped, also referred to as the "initial longitudinal profile". This initial outline 29 is generally defined by the three-dimensional coordinates of a plurality of points $P_i$ in sufficient number to characterize its shape.

The three-dimensional coordinates of these points $P_i$ are expressed in a rectangular coordinate system ($X_2$; $Y_2$; $Z_2$) tied to the selected eyeglass frame, in which the first axis $X_2$ is defined by the horizon of the eyeglass frame 10, the second axis $Y_2$ is directed towards the top of the frame, and the third axis $Z_2$ is normal to the mean plane of the eyeglass frame (typically the plane normal to the axis A4 when the frame is fastened in the outline-reader appliance 100) and is directed towards the front of the frame.

The positioning of this initial outline 29, as identified in the coordinate system of the eyeglass frame, on the ophthalmic lens 20 is described in detail below.

FIG. 3 also has the boxing rectangle B1 of the initial outline 29 drawn in chain-dotted lines. In conventional manner, the boxing rectangle is defined as being the rectangle that circumscribes the projection of the initial outline 29 onto the ($X_2$; $Y_2$) plane, having two sides parallel to the horizon lines 27. The center of the boxing rectangle is referred to as the boxing center E1.

The four points of intersection between the initial outline 29 and the boxing rectangle B1, referred to as "cardinal" points, are respectively referred to as the nose point Pn, the temple point Pt, the high point Ph, and the low point Pb.

Figure 4:
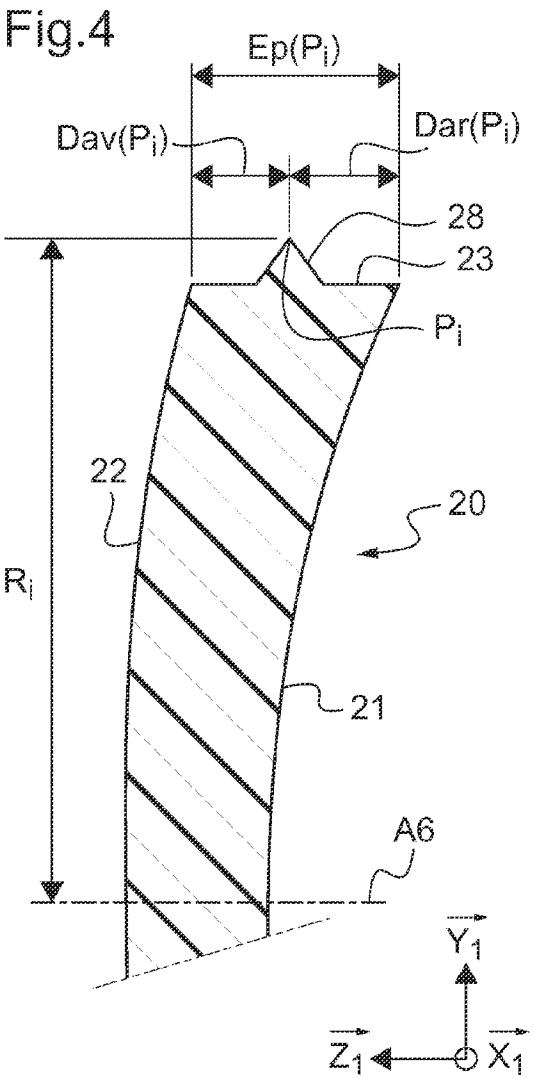
FIG. 4 is a diagrammatic view of a shaped ophthalmic lens shown in section on an axial plane of the ophthalmic lens.

FIG. 4 shows an ophthalmic lens 20 in axial section view, i.e. in section on a plane containing the optical axis A6, and in the shape it presents after it has been machined to have the initial outline 29.

The ophthalmic lens 20 then presents on its edge face an engagement ridge 28 (or "bevel") arranged to engage in the engagement groove (or "bezel") set in the corresponding rim of the eyeglass frame 10.

As can be seen in FIG. 4, the ophthalmic lens 20 presents varying thickness. The variations in the thickness of the lens along the initial outline 29 then form a function written Ep ($P_i$).

This figure also defines the position of the engagement ridge 28 relative to the front face 22 of the ophthalmic lens 20 by means of a distance written Day. The variations in this distance along the initial outline 29 then form a function written Dav ($P_i$).

It is also possible to define the position of the engagement ridge 28 relative to the rear face 21 of the ophthalmic lens 20 by using a distance written Dar. The variations in this distance along the initial outline 29 then form a function written Dar ($P_i$).

Finally, the distribution ratio Re of the point $P_i$ under consideration is defined using the following mathematical formula:

$$Re(P_i)=Dar(P_i)/Ep(P_i)$$

This distribution ratio serves to characterize the distribution between the portion of the edge face 23 of the lens that is situated in front of the engagement ridge 28 and the portion of the edge face 23 of the lens that is situated behind the engagement ridge 28.

Figure 5:
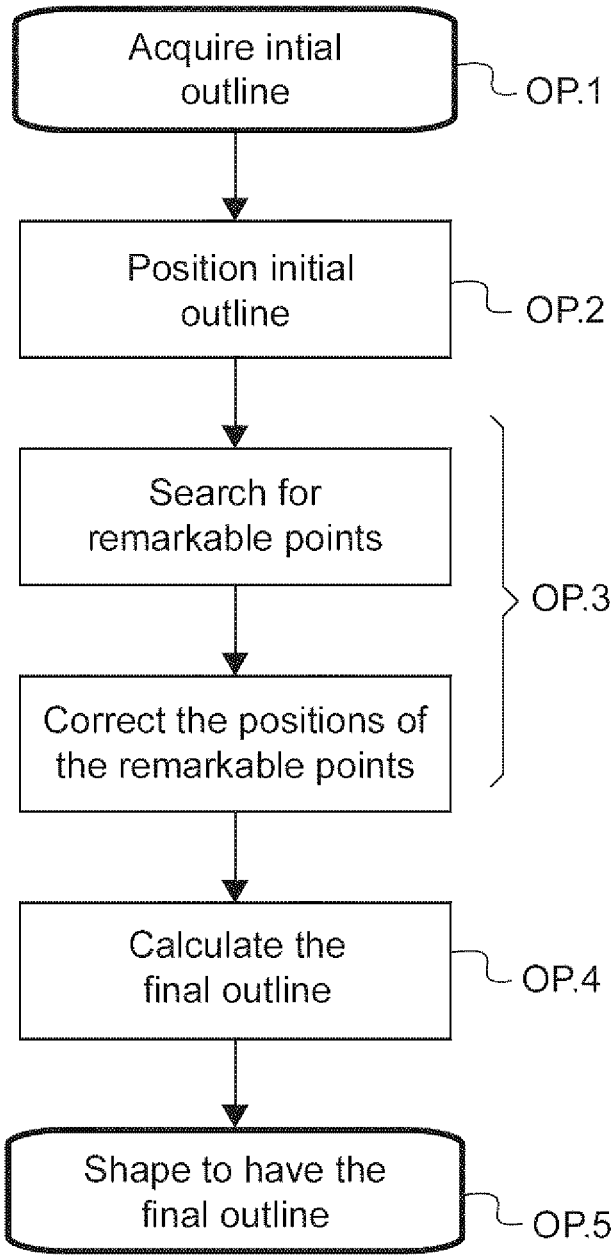
FIG. 5 shows an algorithm representing the main steps of the method of the invention.

As shown in FIG. 5, the method of calculating the three-dimensional shape of the final outline 29' (or "final longitudinal profile) to which the ophthalmic lens 20 is to be beveled comprises five main operations.

These operations are implemented in this example by the control unit 400 while the ophthalmic lens 20 is in position in the centering and blocking appliance 200.

Operation of Acquiring the Initial Longitudinal Profile

During a first operation OP.1, the control unit 400 acquires the three-dimensional shape of the initial outline 29, representative of the shape that the top of the engagement ridge 28 of the ophthalmic lens 20 ought ideally to present in order to engage accurately in the bezel of the corresponding rim of the selected eyeglass frame.

Thus, the initial outline 29 takes no account of the difference in curvature between the rim and the lens, such that the lens generally cannot be shaped to have this outline.

The initial outline 29 presents a shape that is deduced from the shape of the corresponding rim of the eyeglass frame. Nevertheless, this shape is slightly different from that of the rim in order to take account of the phenomenon whereby once the ophthalmic lens 20 has been engaged in the rim, the top of its engagement ridge 28 does not come into contact with the bottom of the bezel, but remains at a distance therefrom.

The acquisition operation OP.1 thus consists in using the three-dimensional coordinates $R_{1i}$, $THETA_{1i}$, $Z_{1i}$ of the 360 points specifying the shape of the edge of the bottom of the bezel to calculate three-dimensional coordinates $R_i$, $THETA_i$, $Z_i$ for 360 points $P_i$ characterizing the shape of this initial outline 29.

For each point $P_i$, the calculation is as follows:

$$R_i=R_{1i}-C1$$

$$THETA_i=THETA_{1i}$$

$$Z_i=Z_{1i}$$

with iranging from 1 to 360, and C1 being a predetermined constant that serves to take the above-mentioned phenomenon into account.

The three-dimensional coordinates $R_i$, $THETA_i$, $Z_i$ of the 360 points $P_i$ characterizing the shape of the initial outline 29 are thus expressed in a coordinate system tied to the outline-reader appliance, and in particular centered on the axis of rotation A4 of the appliance. These coordinates are then corrected so as to be expressed in the coordinate system E1, $X_2$; $Y_2$; $Z_2$ tied to the eyeglass frame.

Operation of Prepositioning the Initial Outline

During a second operation OP.2, the control unit 400 proceeds with prepositioning the initial outline 29 on the ophthalmic lens 20, in the ($X_1$; $Y_1$; $Z_1$) coordinate system.

This prepositioning comprises three steps, namely two preliminary steps and an adjustment step.

The first preliminary step is a centering step. It consists in bringing the coordinate system ($X_2$; $Y_2$; $Z_2$) of the eyeglass rim into coincidence with the coordinate system ($X_1$; $Y_1$; $Z_1$) of the ophthalmic lens in such a manner that their axes are superposed and the optical centering point of the ophthalmic lens 20 coincides with the pupil point identified relative to the initial outline 29.

The second preliminary step is an orientation step, consisting in pivoting the two coordinate systems relative to each other about the axis $Z_1$ and the pupil point through an angle that is a function of the wearer's prescriptions.

These two preliminary steps are well known to the person skilled in the art and do not themselves form the subject matter of the present invention, so they are not described in greater detail herein.

The adjustment step consists in modifying, if necessary, the shape of the initial outline so as to take account of the curvature differences between the rim of the eyeglass frame and the ophthalmic lens 20.

This step may be performed in various ways. For example, it may consist in deforming the initial outline in such a manner as to cause it to lie at half-thickness of the lens.

Nevertheless, in this example, it consists in deforming the initial outline 29 so that it lies at a constant distance from the front face 22 of the ophthalmic lens 20.

More particularly, it consists in modifying the third coordinate $Z_i$ of each of the 360 points $P_i$ in such a manner that each of these points is situated at the same predetermined distance from the front face 21 of the ophthalmic lens 20, which distance is written C2.

The feeler means provided on the centering and blocking appliance 200 are controlled for this purpose to pick up the three-dimensional coordinates $R_{2i}$, $THETA_{2i}$, $Z_{2i}$ of the 360 points of the front face 22 of the lens that are situated respectively in register with each of the 360 points $P_i$.

The third coordinate $Z_i$ of each of the 360 points $P_i$ of the initial outline 29 is then modified using the following formula:

$$Z_i=Z_{2i}-C2, \text{ for i ranging from 1 to 360}$$

This produces the three-dimensional coordinates of the 360 points $P_i$ of the initial outline 29 identified in the coordinate system ($X_1$; $Y_1$; $Z_1$) of the ophthalmic lens 20.

The control unit 400 also usually takes advantage of the feeling of the three-dimensional coordinates $R_{2i}$, $THETA_{2i}$, $Z_{2i}$ of the 360 points of the front face 22 of the ophthalmic lens 20 also to feel the 360 corresponding points of the rear face 21 of the ophthalmic lens 20. This feeling operation enables it to deduce the thickness Ep ($P_i$) of the lens at each of the 360 points $P_i$.

Operation of Searching for Two Remarkable Points

The invention then consists in verifying whether, given the esthetic and mounting parameters for mounting the ophthalmic lens 20 in the corresponding rim of the eyeglass frame, the initial outline 29 is correctly positioned relative to the lens, and if it is not, then in deforming or repositioning the initial outline 29 so as to deduce therefrom the position and the shape of the final outline 29'.

Various criteria, referred to as decision criteria and as positioning criteria are used for this purpose to identify the two remarkable points of the initial outline 29 where the risk is greatest of an esthetic or mounting problem appearing. In the event of the risk being confirmed, one positioning rule then serves to modify the coordinates of the remarkable points so as to make it possible subsequently to modify the position (and possibly also the shape) of the entire initial outline 29 in order to mitigate these problems.

The operation OP.3 of searching for two remarkable points Pr1, Pr2 is then implemented by the control unit 400 using various parameters.

Amongst these parameters, the threshold ratio $Re_{max}$ is a predetermined constant that corresponds to the distribution ratio Re beyond which it is considered that the engagement ridge 28 is situated too close to the front face 22 of the lens, thereby causing too large a fraction of the edge face of the lens to appear behind the rim of the frame in an esthetically unattractive manner. This threshold ratio $Re_{max}$ may for example be selected to be equal to 20%.

The determined ratio $Re_{det}$ corresponds to the distribution ratio that it is desired to use for correcting the position of the initial outline 29 on the edge face of the ophthalmic lens 20 when the distribution ratio Re at the remarkable point under consideration is strictly greater than the threshold ratio $Re_{max}$. This determined ratio $Re_{det}$ may for example be selected to be equal to the threshold ratio $Re_{max}$.

The collision threshold $S_{coll}$ corresponds to the maximum thickness, expressed in millimeters, that needs to be provided between the point Pn (where it is considered that the nose pad is attached to the rim of the frame) and the rear face 21 of the ophthalmic lens 20 so as to ensure that the nose pad of the eyeglass frame does not enter into conflict with the peripheral edge of the rear face of the lens. This collision threshold $S_{coll}$ may either be predetermined (taking a representative sample of eyeglass frames into consideration) and selected to be equal to one millimeter, or else is determined by the optician as a function of the shape of the eyeglass frame that has been selected.

The collision ratio $Re_{coll}$ is a constant that depends directly on the value of the collision threshold $S_{coll}$ and that is calculated using the following mathematical formula:

$$Re_{coll}=S_{coll}/Ep(Pn)$$

The thickness threshold $S_{Ep}$ corresponds to the limit thickness expressed in millimeters beneath which it is considered that it is not possible to modify the position of the engagement ridge 28 on the edge face 23 of the ophthalmic lens 20. Typically, this thickness threshold $S_{Ep}$ may be selected to be equal to the width of the engagement ridge 28, i.e. to the width of the groove in the beveling grindwheel of the shaper appliance 300. Beneath this width, it can be understood that the engagement ridge must necessarily be centered on the edge face of the lens so that at least a central portion of said engagement ridge 28 appears on the edge face of the lens. In a variant, this thickness threshold $S_{Ep}$ may alternatively be predetermined and not be a function of the shaper appliance available to the optician. It may then be selected to be equal to two millimeters, for example.

During the third operation OP.3, the control unit 400 thus searches for two remarkable points Pr1, Pr2 of the initial outline 29 with the help of these various parameters.

Figure 6A:
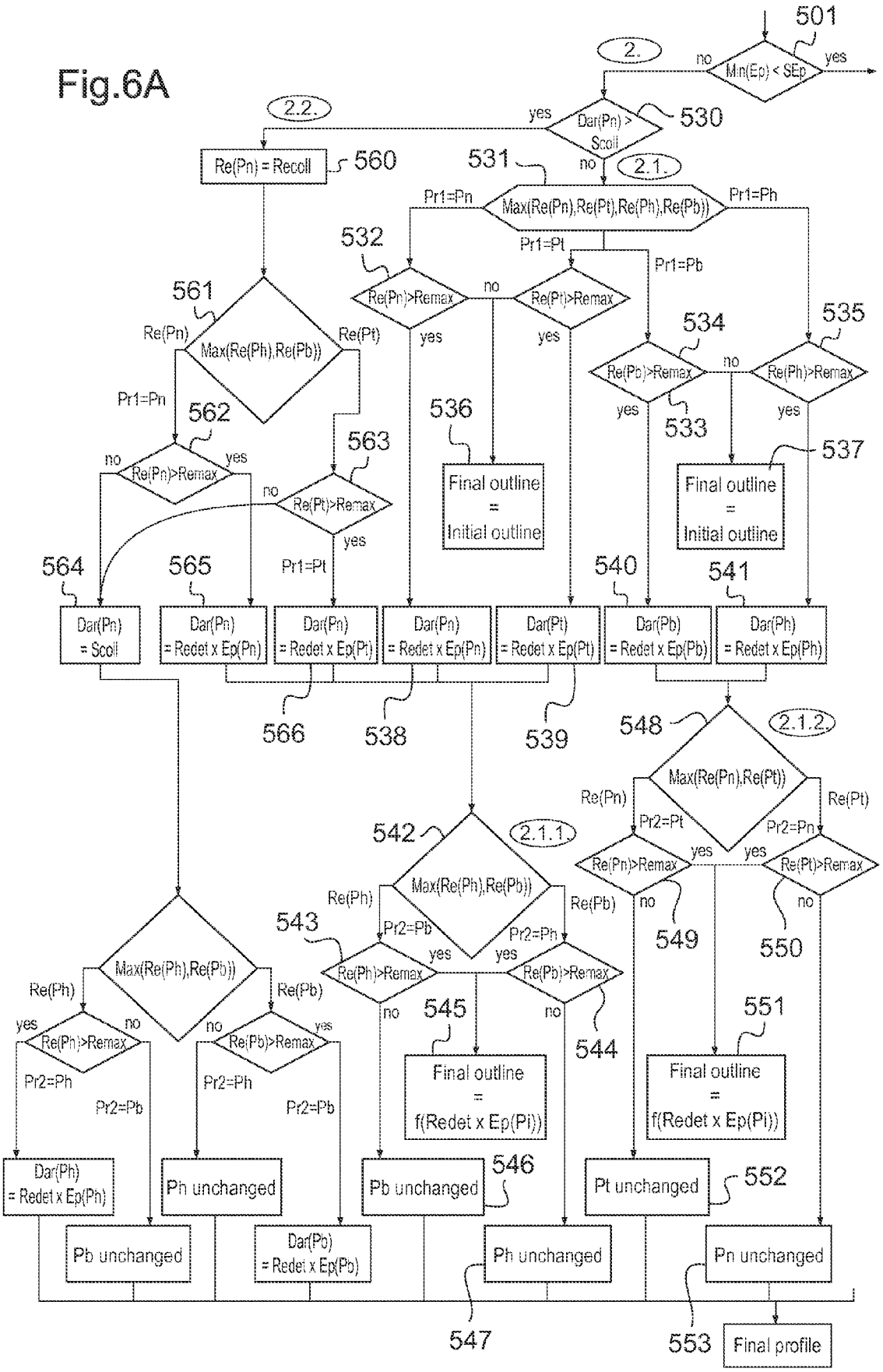
FIGS. 6A and 6B together are a detailed view showing an algorithm for searching for two remarkable points of the outline to which the lens is to be shaped.
Figure 6B:
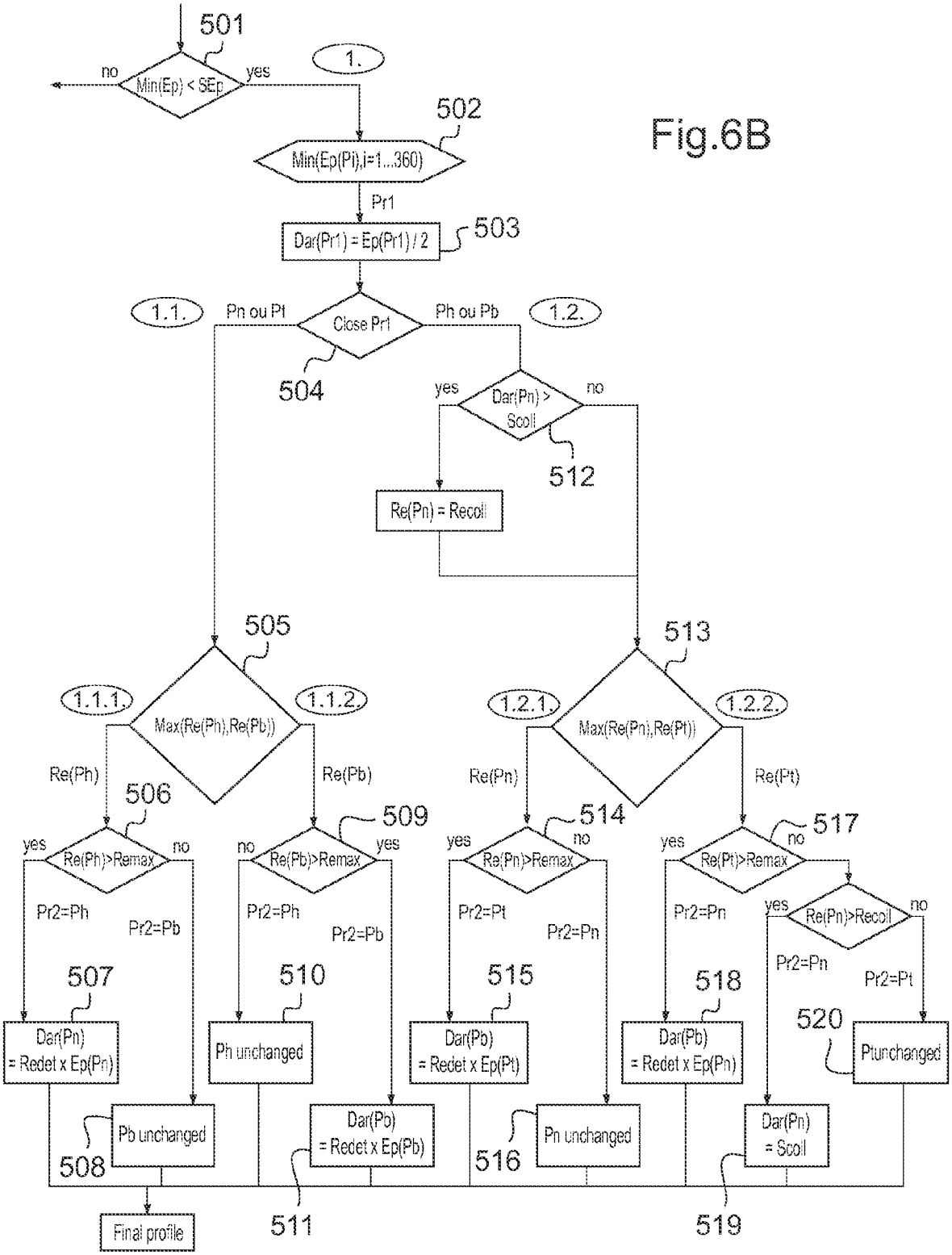

This search operation is shown in detail in the flowchart of FIGS. 6A and 6B.

As shown in these figures, in step 501, the control unit 400 determines whether the thickness function Ep ($P_i$) satisfies a first decision criterion. Here the decision criterion consists in determining whether the minimum thickness of the ophthalmic lens along the initial outline 29 is or is not less than the thickness threshold $S_{Ep}$.

For this purpose, the control unit 400 compares each of the 360 thickness values Ep ($P_i$) as calculated with the thickness threshold $S_{Ep}$.

<Branch 1>

Consideration is given initially to the situation shown in FIG. 6B where the smallest of the calculated thicknesses Ep ($P_i$) is less than the thickness threshold $S_{Ep}$. It can then be understood that an essential condition for the ophthalmic lens 20 to be capable of being mounted in the rim of the eyeglass frame is that the engagement ridge 28 passes via the center of the edge face of the ophthalmic lens at the point on the initial outline 29 where the thickness is at its minimum.

In step 502, the control unit 400 then determines, among the 360 points of the initial outline 29, the point at which the thickness function Ep ($P_i$) satisfies a first positioning criterion. This first positioning criterion in this example consists in determining the point on the initial outline 29 where the thickness of the ophthalmic lens 20 is at a minimum. This point then corresponds to the first remarkable point Pr1.

In step 503, the control unit 400 then modifies the third coordinate $Z_i$ of this remarkable point Pr1 in such a manner as to situate it halfway across the thickness of the edge face 23 of the lens, i.e. at equal distances from the front and rear faces 22 and 21 of the ophthalmic lens 20. Its third coordinate $Z_i$ is than expressed as follows:

$$Z_i=Z_{2i}-Ep(Pr1)/2$$

Once the first remarkable point Pr1 has been found and its axial position has been corrected, the control unit 400 then proceeds to search for the second remarkable point Pr2.

To do this, in step 504, the control unit 400 searches, among the four cardinal points, for the point that is closest to the first remarkable point Pr1.

This search thus serves to establish a list of two cardinal points from which the second remarkable point will be selected.

As can be seen clearly from the description below, the two remarkable points are always selected so as to be situated close to two adjacent cardinal points.

Typically, when the first remarkable point is situated closer to the nose point Pn or to the temple point Pt, the second remarkable point is selected from among the high point and the low point Ph and Pb. In contrast, when the first remarkable point is situated closer to the high point Ph or to the low point Pb, then the second remarkable point is selected from among the nose point Pn and the temple point Pt.

<Branch 1.1>

Consideration is given below to the control unit 400 detecting at the end of step 504 that the point closest to the first remarkable point Pr1 is the nose point Pn or the temple point Pt, with the control unit then drawing up a list of two points from which to select the second remarkable point Pr2, the list comprising the high point Ph and the low point Pb.

In step 505, the control unit 400 then determines, from this list of two points, the point for which the distribution ratio function Re ($P_i$) satisfies a second positioning criterion. This second positioning criterion consists more precisely in determining the point at which the distribution ratio Re is at a maximum, in order to determine the point where the risk of an esthetic defect is the greatest. This criterion thus makes it possible to determine the point having the greatest risk of the edge face 23 of the lens projecting in unsightly manner behind the rim.

<Branch 1.1.1>

Consideration is given to the situation in which the distribution ratio Re ($P_i$) is at a maximum at the high point Ph.

In step 506, the control unit 400 verifies that the distribution ratio Re (Ph) is greater than the threshold ratio $Re_{max}$.

If the distribution ratio Re (Ph) is greater than the threshold ratio $Re_{max}$, then the following step 507 consists in selecting the high point as the second remarkable point Pr2 and in modifying the third coordinate $Z_i$ of this remarkable point Pr2 so as to position the engagement ridge at an esthetically pleasing distance from the front face 22 of the ophthalmic lens. This third coordinate $Z_i$ is then defined as follows:

$$Z_i=Z_{2i}-Ep(Ph)\cdot(1-Re_{det})$$

Otherwise, if the distribution ratio Re (Ph) is less than or equal to the threshold ratio $Re_{max}$, then the following step 508 consists in selecting the low point Pb as the second remarkable point Pr2 and in conserving the third coordinate $Z_i$ of this remarkable point Pr2 unchanged.

<Branch 1.1.2>

Consideration is now given to the situation in which, at the end of step 505, the control unit 400 finds that the distribution ratio Re ($P_i$) is at maximum at the low point Pb.

In step 509, the control unit 400 verifies that this distribution ratio Re (Pb) is greater than the threshold ratio $Re_{max}$.

If the distribution ratio Re (Pb) is greater than the threshold ratio $Re_{max}$, then the following step 511 consists in selecting the low point as the second remarkable point Pr2 and in modifying the third coordinate $Z_i$ of this remarkable point Pr2 in such a manner as to position the engagement ridge at an esthetically pleasing distance from the front face 22 of the ophthalmic lens. This third coordinate $Z_i$ is then defined as follows:

$$Z_i=Z_{2i}-Ep(Pb)\cdot(1-Re_{det})$$

Otherwise, if the distribution ratio Re (Pb) is less than or equal to the threshold ratio $Re_{max}$, then the following step 510 consists in selecting the high point Ph as the second remarkable point Pr2 and in conserving the third coordinate $Z_i$ of this remarkable point Pr2 unchanged.

<Branch 1.2>

Consideration is now given to the situation in which, at the end of step 504, the control unit 400 detects that the point closest to the first remarkable point Pr1 is the low point Pb or the high point Ph, and then draws up a list of two points from which to select the second remarkable point Pr2, which list comprises the nose point Pn and the temple point Pt.

In step 512, before selecting the second remarkable point Pr2, the control unit 400 verifies whether there is any risk of interference between the nose pad of the rim of the frame and the peripheral edge of the rear face 21 of the ophthalmic lens 20.

If such a risk exists, i.e. if the distance Dar (Pn) is greater than the collision threshold $S_{coll}$, then the control unit 400 gives the value of the collision ratio $Re_{coll}$ to the distribution ratio Re (Pn). Otherwise the value of the distribution ratio Re (Pn) remains unchanged.

In step 513, the control unit 400 then determines, from the list of two points, the point at which the distribution ratio function Re ($P_i$) satisfies a second positioning criterion. This second positioning criterion in this example consists likewise in determining the point at which the distribution ratio Re is at a maximum.

<Branch 1.2.1>

Consideration is given to the situation in which the distribution ratio Re ($P_i$) is at a maximum at the nose point Pn.

In step 514, the control unit 400 verifies whether the distribution ratio Re (Pn) is greater than the threshold ratio $Re_{max}$.

If the distribution ratio Re (Pn) is greater than the threshold ratio $Re_{max}$, the following step 515 consists in selecting the temple point as the second remarkable point Pr2 and in modifying the third coordinate $Z_i$ of this remarkable point Pr2 in such a manner as to position the engagement ridge at an esthetically pleasing distance from the front face 22 of the ophthalmic lens. This third coordinate $Z_i$ is then defined as follows:

$$Z_i=Z_{2i}-Ep(Pt)\cdot(1-Re_{det})$$

On the contrary, if the distribution ratio Re (Pn) is less than or equal to the threshold ratio $Re_{max}$, then the following step 516 consists in selecting the nose point Pn as the second remarkable point Pr2 and in conserving the third coordinate $Z_i$ of said remarkable point Pr2 unchanged.

<Branch 1.2.2>

Consideration is now given to the situation in which, at the end of step 513, the control unit finds that the distribution ratio Re ($P_i$) is at a maximum at the temple point Pt.

In step 517, the control unit 400 verifies that this distribution ratio Re (Pt) is greater than the threshold ratio $Re_{max}$.

If the distribution ratio Re (Pt) is greater than the threshold ratio $Re_{max}$, the following step 518 consists in selecting the nose point Pn as the second remarkable point Pr2 and in modifying the third coordinate $Z_i$ of this remarkable point Pr2 in such a manner as to position the engagement ridge at an esthetically pleasing distance from the front face 22 of the lens. This third coordinate $Z_i$ is then defined as follows:

$$Z_i=Z_{2i}-Ep(Pn)\cdot(1-Re_{det})$$

On the contrary, if the distribution ratio Re (Pt) is less than or equal to the threshold ratio $Re_{max}$ and if the distribution ratio Re (Pn) is equal to the collision ratio $Re_{coll}$, then the following step 519 consists in selecting the nose point Pn as the second remarkable point Pr2 and in modifying the third coordinate $Z_i$ of this remarkable point Pr2 in such a manner as to position the engagement ridge at an esthetically pleasing distance from the front face of the lens. This third coordinate $Z_i$ is then defined as follows:

$$Z_i=Z_{2i}-Ep(Pr2)+S_{coll}$$

Finally, if the distribution ratio Re (Pt) is less than or equal to the threshold ratio $Re_{max}$ and if the distribution ratio Re (Pn) is not equal to the collision ratio $Re_{coll}$, then the following step 520 consists in selecting the temple point Pt as the second remarkable point Pr2 and in conserving the third coordinate $Z_i$ of this remarkable point Pr2 unchanged.

<Branch 2>

Consideration is now given to the situation shown in FIG. 6A in which the smallest of the calculated thicknesses Ep ($P_i$) is greater than or equal to the thickness threshold $S_{Ep}$. It can then be understood that it is possible to adjust the actual position of the engagement ridge 28 over the entire periphery of the edge face 23 of the ophthalmic lens 20.

In step 530, the control unit 400 determines whether the function Dar ($P_i$) satisfies a second decision criterion. In this example, this decision criterion consists in determining whether there is a risk of interference between the nose pad of the eyeglass frame and the peripheral edge of the rear face 21 of the ophthalmic lens 20.

For this purpose, the control unit compares the value of this function at the nose point Dar (Pn) with the collision threshold $S_{coll}$.

<Branch 2.1>

Consideration is given initially to the situation in which there is no risk of collision.

In step 531, the control unit 400 then determines, from among the four cardinal points, the point at which the distribution ratio Re ($P_i$) satisfies a first positioning criterion. In this example, this first positioning criterion consists in determining the cardinal point at which the distribution ratio Re ($P_i$) is at a maximum. This point corresponds to the first remarkable point Pr1.

Thereafter, the control unit 400 verifies during a step 532, 533, 534, 535, whether this distribution ratio Re (Pr1) is greater than the threshold ratio $Re_{max}$.

If this distribution ratio Re (Pr1) is greater than or equal to the threshold ratio $Re_{max}$, then these criteria together show that there is no esthetic problem or mounting problem, so there is no need to correct the position of the initial outline 29. Consequently, in the following steps 536, 537, the control unit 400 stops the algorithm and stores in memory the final outline 29' corresponding to the initial outline 29.

In contrast, if the distribution ratio Re (Pr1) is greater than the threshold ratio $Re_{max}$, the following steps 538, 539, 540, 541 consist in modifying the third coordinate $Z_i$ of this remarkable point Pr1 in such a manner as to position the engagement ridge 28 in esthetically pleasing manner on the edge face 23 of the ophthalmic lens 20. The third coordinate $Z_i$ of this remarkable point Pr1 is then defined as follows:

$$Z_i=Z_{2i}-Ep(Pr1)\cdot(1-Re_{det})$$

Once the first remarkable point Pr1 has been found and its axial position has been corrected, the control unit 400 then proceeds to search for the second remarkable point Pr2.

<Branch 2.1.1>

Consideration is given to the situation in which the first remarkable point Pr1 is the nose point Pn or the temple point Pt, with the control unit 400 then drawing up a list of two points from which to select the second remarkable point Pr2, this list comprising the high point Ph and the low point Pb.

In step 542, the control unit 400 then determines, from said list of points, the point at which the distribution ratio Re satisfies a second positioning criterion. This second positioning criterion consists more precisely in determining from among the high and low points Ph and Pb, which point has the maximum distribution ratio Re.

If the distribution ratio Re ($P_i$) is at a maximum at the high point Ph, then the control unit 400 considers that the low point Pb constitutes the second remarkable point Pr2.

Otherwise, if the distribution ratio Re ($P_i$) is at a maximum at the low point Pb, then the control unit 400 considers that the high point Ph constitutes the second remarkable point Pr2.

Then, during a following step 543, 544, the control unit 400 verifies whether the previously calculated maximum distribution ratio is greater than the threshold ratio $Re_{max}$.

If it is, then in a step 545, the control unit stops the algorithm. The final outline 29' is then calculated by correcting the third coordinate $Z_i$ of each point $P_i$ of the final outline 29' using the following formula:

$$Z_i=Z_{2i}-Ep(P_i)\cdot(1-Re_{det})$$

In contrast, if not greater, then in step 546, 547, the control unit 400 continues with the algorithm and conserves the third coordinate $Z_i$ of the second remarkable point Pr2 unchanged.

<Branch 2.1.2>

Consideration is now given to the situation in which the first remarkable point Pr1 is the high point Ph or the low point Pb, with the control unit 400 then drawing up a list of two points from which to select the second remarkable point Pr2, which list comprises the nose point Pn and the temple point Pt.

In step 548, the control unit 400 then determines, from said list of points, the point at which the distribution ratio Re satisfies a second positioning criterion. This second positioning criterion consists more particularly in determining, from the nose and temple points Pn and Pt, the point at which the distribution ratio Re is at a maximum.

If the distribution ratio Re ($P_i$) is at a maximum at the nose point Pn, then the control unit 400 considers that the temple point Pt constitutes the second remarkable point Pr2.

In contrast, if the distribution ratio Re ($P_i$) is at a maximum at the temple point Pt, then the control unit 400 considers that the nose point Pn constitutes the second remarkable point Pr2.

Then, during a following step 549, 550, the control unit 400 verifies whether the previously calculated maximum distribution ratio is greater than the threshold ratio $Re_{max}$.

If so, then in step 551, the control unit stops the algorithm. The final outline 29' is then calculated by correcting the third coordinate $Z_i$ of each point $P_i$ of the final outline 29' in application of the following formula:

$$Z_i=Z_{2i}-Ep(P_i)\cdot(1-Re_{det})$$

In contrast, if not so, then in step 552, 553, the control unit 400 continues the algorithm and conserves the third coordinate $Z_i$ of the second remarkable point Pr2 unchanged.

<Branch 2.2>

Consideration is now given to the situation in which the control unit 400 observes at the end of step 530 that there is a risk of collision between the nose pad of the rim of the frame and the peripheral edge of the rear face 21 of the ophthalmic lens 20.

In step 560, the control unit 400 gives the collision ratio value $Re_{coll}$ to the distribution ratio at the nose point Re (Pn).

Then, in step 561, the control unit 400 determines from the list of points constituted by the nose point Pn and the temple point Pt, which is the point having the distribution ratio Re ($P_i$) that satisfies a first positioning criterion. In this example, this positioning criterion consists in determining the point at which the distribution ratio Re ($P_i$) is at a maximum.

If the distribution ratio Re ($P_i$) is at a maximum at the nose point Pn, the nose point Pn is considered as being the first remarkable point Pr1. This is the point where there is the greatest risk of there being an assembly problem or an esthetic problem.

Thereafter, in step 562, the control unit 400 verifies whether the distribution ratio Re (Pr1) is greater than the threshold ratio $Re_{max}$.

If this distribution ratio Re (Pr1) is less than or equal to the threshold ratio $Re_{max}$, then the following step 564 consists in modifying the third coordinate $Z_i$ of the first remarkable point Pr1 in such a manner as to avoid any problem of mounting the ophthalmic lens 20 in its rim. The third coordinate $Z_i$ of this remarkable point Pr1 is then defined as follows:

$$Z_i=Z_{2i}-Ep(Pr1)+S_{coll}$$

The search for the second remarkable point Pr2 and the correction of its third coordinate $Z_i$ are then performed in the same manner as described for branch 1.1.1 of the flowchart.

Otherwise, if the distribution ratio Re (Pr1) is greater than the threshold ratio $Re_{max}$, then the following step 565 consists in modifying even more greatly the third coordinate $Z_i$ of this first remarkable point Pr1 so as to avoid any esthetic appearance problem. The third coordinate $Z_i$ of this remarkable point Pr1 is then defined as follows:

$$Z_i=Z_{2i}-Ep(Pr1)\cdot(1-Re_{det})$$

The search for the second remarkable point Pr2 and the correction of its third coordinate $Z_i$ are then performed as described for branch 2.1.1 of the flowchart.

Consideration is now given to the situation in which, at the end of step 561, the control unit 400 observes that the distribution ratio Re ($P_i$) is at a maximum at the temple point Pt.

Then, in step 563, the control unit 400 verifies whether this distribution ratio Re (Pt) is greater than the threshold ratio $Re_{max}$.

If not, the risk of collision between the pad and the lens is considered to be essential. The nose point Pn is then considered as being the first remarkable point Pr1 and the algorithm is directed to above-described step 564.

Otherwise, if the distribution ratio Re (Pt) is greater than the threshold ratio $Re_{max}$, the temple point Pt is considered as being the first remarkable point Pr1.

The following step 566 then consists in modifying the third coordinate $Z_i$ of this first remarkable point Pr1 so as to avoid any esthetic appearance problem. This modification is assumed to interact sufficiently on the position of the nose point Pn to avoid any collision problem between the nose pad and the ophthalmic lens. The third coordinate $Z_i$ of the remarkable point Pr1 is then defined as follows:

$$Z_i=Z_{2i}-Ep(Pt)\cdot(1-Re_{det})$$

The search for the second remarkable point Pr2 and the correction of its third coordinate $Z_i$ are then performed as described above for branch 2.1.1 of the flowchart.

Calculating the Final Longitudinal Profile

During a fourth operation OP.4, the control unit 400 calculates the shape of the final outline 29'. The final outline 29' is defined as resulting from a geometrical transformation of the initial outline 29 that is such as to cause the final outline 29' to pass via the two remarkable points Pr1 and Pr2.

In this example, this transformation consists in modifying the third coordinates $Z_i$ of all of the points $P_i$ of the initial outline 29 using the following mathematical formula:

$$Z'=a\cdot Z_i+b$$

where a and b are constants that are determined as a function of the modifications to the axial positions of the remarkable points Pr1 and Pr2.

This transformation could naturally be performed in some other way. In particular, it could apply not only to the third coordinates $Z_i$ of the points $P_i$ of the initial outline 29, but to all three of their coordinates. In this variant, provision may typically be made to avoid changing the shape of the initial outline 29, while modifying only its position by causing it to tilt in such a manner as to pass through the two remarkable points Pr1 and Pr2.

Shaping Operation

During a fifth operation OP.5, the control unit 400 controls the shaping of the ophthalmic lens 20 using the shaper appliance 300.

In this example, this shaping operation is performed in two stages: roughing out; and finishing.

To rough out the lens, a cylindrical grindwheel is used that enables the radii of the lens to be reduced coarsely as a function of the shape of the final outline 29'.

Thereafter, in order to finish the lens, a beveling grindwheel is used that serves to form the engagement ridge 28 on the edge face 23 of the ophthalmic lens 20 in such a manner that the top of this ridge presents exactly the shape of the final outline 29' positioned in the coordinate system of the ophthalmic lens 20.

Once shaped, the ophthalmic lens 20 is extracted from the shaper appliance 300 and is then engaged in the corresponding rim of the eyeglass frame 10.

The present invention is not limited in any way to the implementation described and shown, and the person skilled in the art knows how to apply any variation thereto in accordance with its spirit.

As explained above, the invention also applies to preparing ophthalmic lenses for mounting in half-rimmed eyeglass frames. The method of calculating the final outline is then performed in five operations.

During the first operation, the control unit acquires the two-dimensional shape of the initial outline, e.g. from a photograph of the presentation lens fitted to the half-rimmed eyeglass frame. The photograph is processed in order to determine the coordinates $THETA_i$, of the 360 points of the outline of the presentation lens.

During the second operation, the control unit prepositions the final outline on the ophthalmic lens in three centering, orientation, and adjustment steps that are identical to those described above.

During the third and fourth operations, the control unit searches for the two remarkable points of this initial outline and deduces therefrom the shape of the final outline in the coordinate system of the ophthalmic lens (i.e. the shape and the position of this final outline on the ophthalmic lens).

Finally, during the fifth operation, the control unit controls the shaping of the ophthalmic lens in a roughing-out stage and a finishing stage. In order to finish the lens, a cutter is used that is provided on the finishing module 303 of the shaper appliance 300 for the purpose of forming an engagement groove all along its periphery.

Once shaped, the ophthalmic lens is extracted from the shaper appliance and is then engaged on the ridge provided on the inside face of the corresponding half-rim of the eyeglass frame. It is then held in position using a nylon string engaged in its engagement groove and connected to the ends of the half-rim.

The invention claimed is:

1. A method of calculating a shape of a longitudinal profile of an engagement ridge or groove (28) for machining on the edge face (23) of an ophthalmic lens (20) in order to enable the ophthalmic lens to be engaged into a bezel or onto a ridge of an eyeglass frame, the method comprising:

an operation of acquiring with an outline-reader appliance (100) a shape of an initial longitudinal profile (29);

an operation of prepositioning said initial longitudinal profile (29) in a coordinate system tied to the ophthalmic lens (20);

an operation of searching for two remarkable points (Pr1, Pr2) of said initial longitudinal profile (29), which points are distinct from each other, said operation comprising:

a) acquiring a plurality of characteristics relating to the ophthalmic lens (20) or to the initial longitudinal profile (29);

b) determining whether any of said acquired characteristics satisfies a decision criterion, by comparing the value of said acquired characteristic with a predetermined threshold value;

c) selecting the first remarkable point (Pr1) from a first list of points of said initial longitudinal profile (29) as being the point at which one of said acquired characteristics satisfies a first positioning criterion, said first positioning criterion being selected as a function of the result of step b); and d) selecting the second remarkable point (Pr2) from a second list of points of said initial longitudinal profile (29), as being the point at which one of said acquired characteristics satisfies a second positioning criterion, said second list being deduced from the result of step c);

an operation of correcting the position of each remarkable point (Pr1, Pr2) along an axial direction ($Z_1$) substantially perpendicular to a mean plane of the ophthalmic lens (20); and an operation of calculating with a control unit (400) the three-dimensional shape of a final longitudinal profile (29') in the coordinate system of the ophthalmic lens (20), resulting from a geometrical transformation of the initial longitudinal profile (29) that is such as to cause the final longitudinal profile (29') to pass via the first and second remarkable points (Pr1, Pr2) as modified during the preceding operation.

2. The calculation method according to claim 1, wherein each positioning criterion includes selecting from the points of the first or second list of points, the point at which the value of the acquired characteristic is at a maximum or a minimum.

3. The calculation method according to claim 1, wherein each characteristic acquired in step a) relates to the shape of the ophthalmic lens (20) or to the axial position of the initial longitudinal profile (29) relative to one of the optical faces (21, 22) of the ophthalmic lens (20).

4. The calculation method according to claim 1, wherein, in step b), said decision criterion relates to a thickness (Ep) of the ophthalmic lens (20) at at least one point of the initial longitudinal profile (29).

5. The calculation method according to claim 4, wherein said decision criterion includes determining whether the minimum thickness (Ep) of the ophthalmic lens (20) along the initial longitudinal profile (29) is less than a thickness threshold ($S_{Ep}$).

6. The calculation method according to claim 4, wherein said decision criterion includes determining whether an axial distance (Dar) between the rear face (21) of the ophthalmic lens (20) and the initial longitudinal profile (29) is, at at least one point situated in a nose zone of said initial longitudinal profile (29), less than an interference threshold ($S_{coll}$) .

7. The calculation method according to claim 1, wherein, in step b), if the decision criterion is not satisfied, provision is made for determining whether one of the characteristics acquired in step a) satisfies another decision criterion, and in step c), the first positioning criterion is selected also as a function of the result obtained with said other decision criterion.

8. The calculation method according to claim 1, wherein, in step c), the first positioning criterion relates to a minimum thickness (Ep) of the ophthalmic lens (20) along the initial longitudinal profile (29), and the first remarkable point (Pr1) corresponds to the point of the initial longitudinal profile (29) at which the thickness of the ophthalmic lens (20) is at a minimum.

9. The calculation method according to claim 1, wherein, in step c), the first positioning criterion relates to a ratio (Re) of an axial distance (Dar) between the initial longitudinal profile (29) and one of the optical faces (21, 22) of the ophthalmic lens (20) divided by a thickness (Ep) of the ophthalmic lens (20).

10. The calculation method according to claim 9, wherein, for said optical face being the rear face (21) of the ophthalmic lens (20), the first remarkable point (Pr1) corresponds to the point in the first list that presents the maximum ratio (Re).

11. The calculation method according to claim 9, wherein the first list of points comprises exactly four points (Ph, Pb, Pn, Pt) respectively situated at less than ten millimeters in curvilinear abscissa from the four points of intersection between the initial longitudinal profile (29) and the two axes of symmetry of the boxing rectangle (B1) of said initial longitudinal profile (29).

12. The method according to claim 9, wherein the first list of points comprises exactly four points (Ph, Pb, Pn, Pt) respectively situated at the intersections of the initial longitudinal profile (29) and the boxing rectangle (B1) of said initial longitudinal profile (29).

13. The calculation method according to claim 12, wherein the second list comprises two points (Ph, Pb, Pn, Pt) situated at less than ten millimeters in curvilinear abscissa from the two points of intersection between the initial longitudinal profile (29) and one of the two axes of symmetry of the boxing rectangle (B1) of said initial longitudinal profile (29), said axis of symmetry being the axis of symmetry that is the furthest away from the first remarkable point (Pr1).

14. The calculation method according to claim 9, wherein the ratio Re of a point $P_i$ under consideration is defined using a following mathematical formula:

$$Re(P_i)=Dar(P_i)/Ep(P_i).$$

15. The calculation method according to claim 1, wherein the second positioning criterion relates to the ratio (Re) of an axial distance (Dar) between the initial longitudinal profile (29) and one of the optical faces (21) of the ophthalmic lens (20) divided by a thickness (Ep) of the ophthalmic lens (20).

16. The calculation method according to claim 1, wherein, in step d), the second remarkable point (Pr2) is selected in such a manner that it lies at at least thirty millimeters in curvilinear abscissa from the first remarkable point (Pr1).

17. The calculation method according to claim 1, wherein the operation of acquiring includes using three-dimensional coordinates $R_{1i}$, $THETA_{1i}$, $Z_{1i}$of 360 points specifying a shape of an edge of a bottom of the bezel to calculate three-dimensional coordinates $R_i$, $THETA_i$, $Z_i$for 360 points $P_i$characterizing the shape of initial longitudinal profile (29).

18. The calculation method according to claim 17, wherein each point $P_i$is calculated as follows:

$$R_i=R_{1i}-C1$$

$$THETA_i=THETA_{1i}$$

$$Z_i=Z_{1i}$$

with i ranging from 1 to 360, and C1being a predetermined constant.

19. A method of calculating a shape of a longitudinal profile of an engagement ridge or groove (28) for machining on the edge face (23) of an ophthalmic lens (20), the method comprising:

an operation of acquiring with an outline-reader appliance (100) a shape of an initial longitudinal profile (29);

an operation of prepositioning said initial longitudinal profile (29) in a coordinate system tied to the ophthalmic lens (20);

an operation of searching for two remarkable points (Pr1, Pr2) of said initial longitudinal profile (29), which points are distinct from each other, said operation comprising:

a) acquiring a plurality of characteristics relating to the ophthalmic lens (20) or to the initial longitudinal profile (29);

b) determining whether any of said acquired characteristics satisfies a decision criterion, by comparing the value of said acquired characteristic with a predetermined threshold value;

c) selecting the first remarkable point (Pr1) from a first list of points of said initial longitudinal profile (29) as being the point at which one of said acquired characteristics satisfies a first positioning criterion, said first positioning criterion being selected as a function of the result of step b); and d) selecting the second remarkable point (Pr2) from a second list of points of said initial longitudinal profile (29), as being the point at which one of said acquired characteristics satisfies a second positioning criterion, said second list being deduced from the result of step c);

an operation of correcting the position of each remarkable point (Pr1, Pr2) along an axial direction ($Z_1$) substantially perpendicular to a mean plane of the ophthalmic lens (20); and an operation of calculating with a control unit (400) the three-dimensional shape of a final longitudinal profile (29') in the coordinate system of the ophthalmic lens (20), resulting from a geometrical transformation of the initial longitudinal profile (29) that is such as to cause the final longitudinal profile (29') to pass via the first and second remarkable points (Pr1, Pr2) as modified during the preceding operation, wherein each positioning criterion includes selecting from the points of the first or second list of points, the point at which the value of the acquired characteristic is at a maximum or a minimum.

20. A method of calculating a shape of a longitudinal profile of an engagement ridge or groove (28) for machining on the edge face (23) of an ophthalmic lens (20), the method comprising:

an operation of acquiring with an outline-reader appliance (100) a shape of an initial longitudinal profile (29);

an operation of prepositioning said initial longitudinal profile (29) in a coordinate system tied to the ophthalmic lens (20);

an operation of searching for two remarkable points (Pr1, Pr2) of said initial longitudinal profile (29), which points are distinct from each other, said operation comprising:

a) acquiring a plurality of characteristics relating to the ophthalmic lens (20) or to the initial longitudinal profile (29);

b) determining whether any of said acquired characteristics satisfies a decision criterion, by comparing the value of said acquired characteristic with a predetermined threshold value;

c) selecting the first remarkable point (Pr1) from a first list of points of said initial longitudinal profile (29) as being the point at which one of said acquired characteristics satisfies a first positioning criterion, said first positioning criterion being selected as a function of the result of step b); and d) selecting the second remarkable point (Pr2) from a second list of points of said initial longitudinal profile (29), as being the point at which one of said acquired characteristics satisfies a second positioning criterion, said second list being deduced from the result of step c);

an operation of correcting the position of each remarkable point (Pr1, Pr2) along an axial direction ($Z_1$) substantially perpendicular to a mean plane of the ophthalmic lens (20); and an operation of calculating with a control unit (400) the three-dimensional shape of a final longitudinal profile (29') in the coordinate system of the ophthalmic lens (20), resulting from a geometrical transformation of the initial longitudinal profile (29) that is such as to cause the final longitudinal profile (29') to pass via the first and second remarkable points (Pr1, Pr2) as modified during the preceding operation, wherein, in step b), if the decision criterion is not satisfied, provision is made for determining whether one of the characteristics acquired in step a) satisfies another decision criterion, and in step c), the first positioning criterion is selected also as a function of the result obtained with said other decision criterion.

* * * * *

UNITED STATES PATENT AND TRADEMARK OFFICE

CERTIFICATE OF CORRECTION

PATENT NO. : 8,523,353 B2
APPLICATION NO. : 13/179022
DATED : September 3, 2013
INVENTOR(S) : Jérémie Biton et al.

It is certified that error appears in the above-identified patent and that said Letters Patent is hereby corrected as shown below:

In the Specification

In column 3, lines 34-36 should read as follows:

-- in step b), said decision criterion relates to the thickness of the ophthalmic lens at at least one point of the initial longitudinal profile; --

In column 3, lines 41-45 should read as follows:

-- said decision criterion consists in determining whether the axial distance between the rear face of the ophthalmic lens and the initial longitudinal profile is, at at least one point situated in a nose zone of said initial longitudinal profile, less than an interference threshold; --

In column 9, line 5-9 should read as follows:

-- This figure also defines the position of the engagement ridge 28 relative to the front face 22 of the ophthalmic lens 20 by means of a distance written Dav. The variations in this distance along the initial outline 29 then form a function written $Dav(P_i)$. --

In column 9, lines 55-64 should read as follows:

-- For each point $P_i$, the calculation is as follows:

$R_i = R_{1i} - C_1$ $THETA_i = THETA_{1i}$ $Z_i - Z_{1i}$ with i ranging from 1 to 360, and $C_1$ being a predetermined constant that serves to take the above mentioned phenomenon into account. --

Signed and Sealed this
Thirty-first Day of December, 2013

Margaret A. Focarino

Margaret A. Focarino
*Commissioner for Patents of the United States Patent and Trademark Office*

In column 18, line 16-21 should read as follows:

-- During the first operation, the control unit acquires the two-dimensional shape of the initial outline, e.g. from a photograph of the presentation lens fitted to the half-rimmed eyeglass frame. The photograph is processed in order to determine the coordinates $R_i$, $THETA_i$, of the 360 points of the outline of the presentation lens. --